US007883309B2

(12) United States Patent
Smith et al.

(10) Patent No.: US 7,883,309 B2
(45) Date of Patent: Feb. 8, 2011

(54) METHOD AND APPARATUS FOR HANDLING PIPE

(75) Inventors: Shawn R. Smith, Hillsboro, OR (US); Harlan B. Smith, Hillsboro, OR (US)

(73) Assignee: Columbia Trailer Co., Inc., Hillsboro, OR (US)

( * ) Notice: Subject to any disclaimer, the term of this patent is extended or adjusted under 35 U.S.C. 154(b) by 296 days.

(21) Appl. No.: 12/220,936

(22) Filed: Jul. 29, 2008

(65) Prior Publication Data

US 2010/0111646 A1 May 6, 2010

Related U.S. Application Data

(63) Continuation of application No. 11/649,957, filed on Jan. 5, 2007, now abandoned, which is a continuation of application No. 11/449,978, filed on Jun. 9, 2006, now abandoned.

(51) Int. Cl.
*E21B 19/14* (2006.01)
*E21B 19/15* (2006.01)
*E21B 19/00* (2006.01)

(52) U.S. Cl. ..... 414/22.55; 212/231

(58) Field of Classification Search ..... 14/71.7, 14/72.5; 175/52, 85; 198/315, 316.1, 318; 212/231, 264, 348; 414/22.51–22.59, 22.61–22.62, 414/23, 718, 728; 89/1.805
See application file for complete search history.

(56) References Cited

U.S. PATENT DOCUMENTS

| | | | | |
|---|---|---|---|---|
| 1,817,789 | A * | 8/1931 | Waechter et al. | 37/190 |
| 2,956,691 | A * | 10/1960 | Fangman | 414/541 |
| 3,913,756 | A * | 10/1975 | Barron et al. | 414/586 |
| 2004/0208730 | A1 * | 10/2004 | Morelli et al. | 414/22.59 |
| 2005/0238463 | A1 * | 10/2005 | Smith | 414/22.52 |
| 2007/0017703 | A1 * | 1/2007 | Belik | 175/52 |
| 2007/0286708 | A1 * | 12/2007 | Smith et al. | 414/22.58 |

FOREIGN PATENT DOCUMENTS

WO WO 0142618 A1 * 6/2001

* cited by examiner

*Primary Examiner*—Gregory W Adams
(74) *Attorney, Agent, or Firm*—Kolisch Hartwell, P.C.

(57) ABSTRACT

An apparatus and method for handling pipe includes an elongate frame structure for mounting on a ground surface, in which a carriage unit is mounted on the frame structure and is operable for selective and reciprocal shifting along the frame structure. A boom member mounted on the carriage unit is operable for selected pivotal movement relative to the carriage unit, and a plane generally parallel to the boom member's longitudinal axis, about a generally horizontal pivot axis oriented transverse to the direction of shifting of the carriage unit along the frame structure. An elongate pipe carrier mounted on the boom member as dimensioned for receiving pipe so that the pipe's longitudinal axis is substantially parallel to the longitudinal axis of the boom member and the pipe member, wherein the pipe carrier is operable for selective pivotal movement about its longitudinal axis.

10 Claims, 18 Drawing Sheets

METHOD AND APPARATUS FOR HANDLING PIPE

CROSS-REFERENCE TO RELATED APPLICATIONS

This application is a continuation of U.S. patent application Ser. No. 11/649,957, filed Jan. 5, 2007 now abandoned, which is a continuation of U.S. patent application Ser. No. 11/449,978, filed Jun. 9, 2006 now abandoned, the entire disclosures of which are herein incorporated by reference for all purposes.

BACKGROUND AND SUMMARY OF THE INVENTION

The present invention is directed to a novel method and apparatus for handling pipe, and in particular, presenting drill pipe to drilling rigs, where the pipe may range up to about 30-40 feet in length, have diameters in the range of 3 inches and above, and weigh in the neighborhood of 500 pounds or more. The method and apparatus of the present invention could also be used for larger or smaller pipe, and the design of the essential components of the present invention readily enables that. For purposes of the description, and in the drawing figures which follow, the method and apparatus will be described with respect to handling pipe in the size and weight range as mentioned above.

There are numerous proposals in the prior art for handling pipe, but the present invention provides a simple, effective construction which is believed to be significantly advantageous. In its most essential form, the present invention includes an apparatus for handling pipe which includes only minimal moving parts, and the components are arranged for efficient operation; in particular, the present invention may be thought of as having a minimal number of essential components. The first is an elongate frame along which a power-driven carriage can reciprocally translate. Mounted on the carriage is a boom, connected to the carriage by a boom mount which is a pivot assembly. The boom is pivotal about a pivot axis defined by the pivot assembly, and the boom is positionable on the pivot assembly so that the boom will pivot at a selected position along its longitudinal axis.

This construction enables the boom to be pivoted to different heights, depending upon its mounting on the pivot assembly, in other words, the boom is pivoted relative to the carriage at a selected position along the boom's length. The boom carries a pipe carrier which may be rotated along a longitudinal axis parallel to the longitudinal axis of the boom. Rigidly mounted elevator arms are connected to the pipe carrier for picking off pipe from a pipe rack or the like, and placing the pipe in the pipe carrier. The power-driven carriage may be advanced and the boom pivoted about the pivot axis to lower the rear of the boom and consequently raise its front end, and the front end of the pipe carrier to present a pipe to the floor of a drill rig.

While the above has been generally described, further more specific details of the present invention will be understood from a consideration of the brief description of the drawings and the detailed description of the preferred embodiment which follows.

BRIEF DESCRIPTION OF THE DRAWINGS

FIG. 5A is a side elevation view of the apparatus shown in the configuration of FIG. 5;

DETAILED DESCRIPTION OF THE PREFERRED EMBODIMENT

Figure 1:
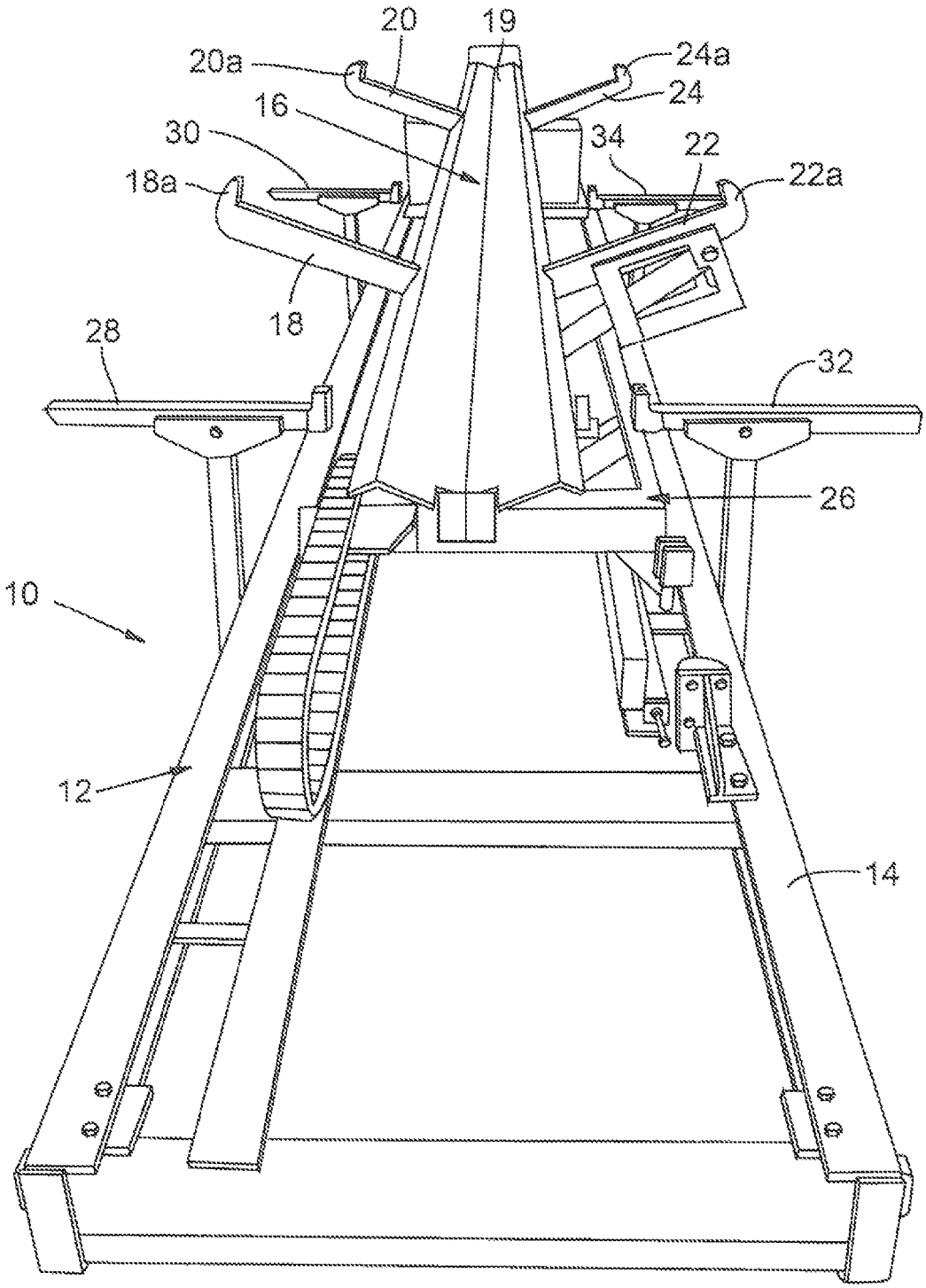
FIG. 1 is a frontal view, taken slightly from above and looking toward the rear of the pipe handling apparatus and illustrates the pipe carrier in its neutral position.

The present invention is directed to a method and apparatus for handling pipe so that pipe can be picked up from a pipe rack and presented to drill rigs having drill floors at different elevations, i.e., from ground level upwards of 15 feet. It is advantageous to have an apparatus which can be readily adjusted in the field to handle pipe for delivery to and removal from drilling rigs having drill floors which are at different elevations. In addition it may be necessary to move a pipe handling apparatus to different, and a relatively small, adjustable apparatus which is simple in operation will prove advantageous. While the configuration of the pipe handling apparatus of the present invention could be increased in size to reach the floors of drill rigs of even greater heights than 15 feet or so, the apparatus of the present invention has been designed to handle pipe upwards of 30 feet, and with diameters of 3-4 inches, weighing in the neighborhood of 500 pounds, although pipe of different diameters, lengths, and weights could be accommodated.

The present invention is directed to a pipe handling apparatus which includes several principal components, which enable it to efficiently transfer pipe from a pipe rack, advance the pipe to a drill rig and then present one end of the pipe to the drill rig, at various drill rig floor heights. To this end, the principal components of the pipe handling apparatus include an elongate, ground-mounted subframe or frame structure on which a power-driven carriage unit is mounted, selectively operable for reciprocal shifting along the frame structure. A boom is mounted on the carriage unit and is operable for selected pivotal movement relative to the carriage unit, about a generally horizontal pivot axis oriented transverse to the direction of reciprocal shifting of the carriage unit, and an elongate pipe carrier is mounted on the boom dimensioned for receiving pipe so that the pipe's longitudinal axis is substantially parallel to the longitudinal axis of the boom and the pipe carrier.

The pipe carrier is mounted on the boom and is operable for selective rotation about a longitudinal axis parallel to the longitudinal axis of the boom to pick up pipe arranged on a pipe rack generally parallel to the boom. The carriage is operable for delivering the pipe so that an end of the pipe is presented to a drill rig, where the pipe can then be off loaded by a lifting device, such as a draw works. The end of the pipe presented to the drill rig can be raised to a preselected height determined by the position in which the boom is pivoted relative to the carriage. That is, if the pivotal movement of the boom is about a pivot axis adjacent the front end of the boom, then the front end of the boom and correspondingly the pipe carrier is limited to the extent that it can be pivoted above the ground. Conversely, if the pivot connection of the boom is positioned further, along the long axis of the boom, then the front of the boom and the front of the pipe carried on the pipe carrier can be presented to a drill rig floor at a greater height.

The present invention provides a pipe handling apparatus in which the pivot assembly is mounted to the carriage, and includes a sleeve, dimensioned to receive the boom. The sleeve includes a mechanism to clamp the sleeve to the boom, at a selected position along the length of the boom. Therefore, the boom can be pivoted about a selected pivot axis along its longitudinal axis. The pivot axis of the pivot assembly remains constant; it is the relative positioning of the boom within the sleeve which enables the boom to reach different elevations.

As shown in FIG. 1, which is a front slightly elevated view taken from above, the pipe handling apparatus of the present invention is generally indicated at 10, and includes an elongate frame structure or subframe which includes opposed, spaced-apart elongate members 12 and 14, interconnected by suitable structural cross members. A pipe carrier is generally indicated at 16, and includes spaced-apart elevator arms 18 and 20 rigidly connected thereto and extending at an angle outwardly from one side of the side of the pipe carrier and opposed elevator arms 22 and 24 rigidly connected and extending outwardly at an angle from the other side of pipe carrier 16. The elevator arms are angled about 20° relative to the horizontal. As mentioned previously, the pipe carrier is mounted on a boom, which in turn is mounted on a pivot assembly, in turn mounted on a carriage. The carriage, partially shown in FIG. 1, is generally indicated at 26, and is power-driven for reciprocal shifting along the frame structure.

Also shown in FIG. 1 are interface arms, such as shown at 28 and 30, mounted to one side of the subframe and on the opposite side, interface arms 32 and 34 are mounted. In the manner which will be described later, it will be seen that the interface arms are mounted on uprights, and can pivot about an associated horizontal axis, thereby to facilitate pick-up by the elevator arms onto the pipe carrier or, in an offloading sequence, to facilitate the pipe being "kicked off."

Figure 2:
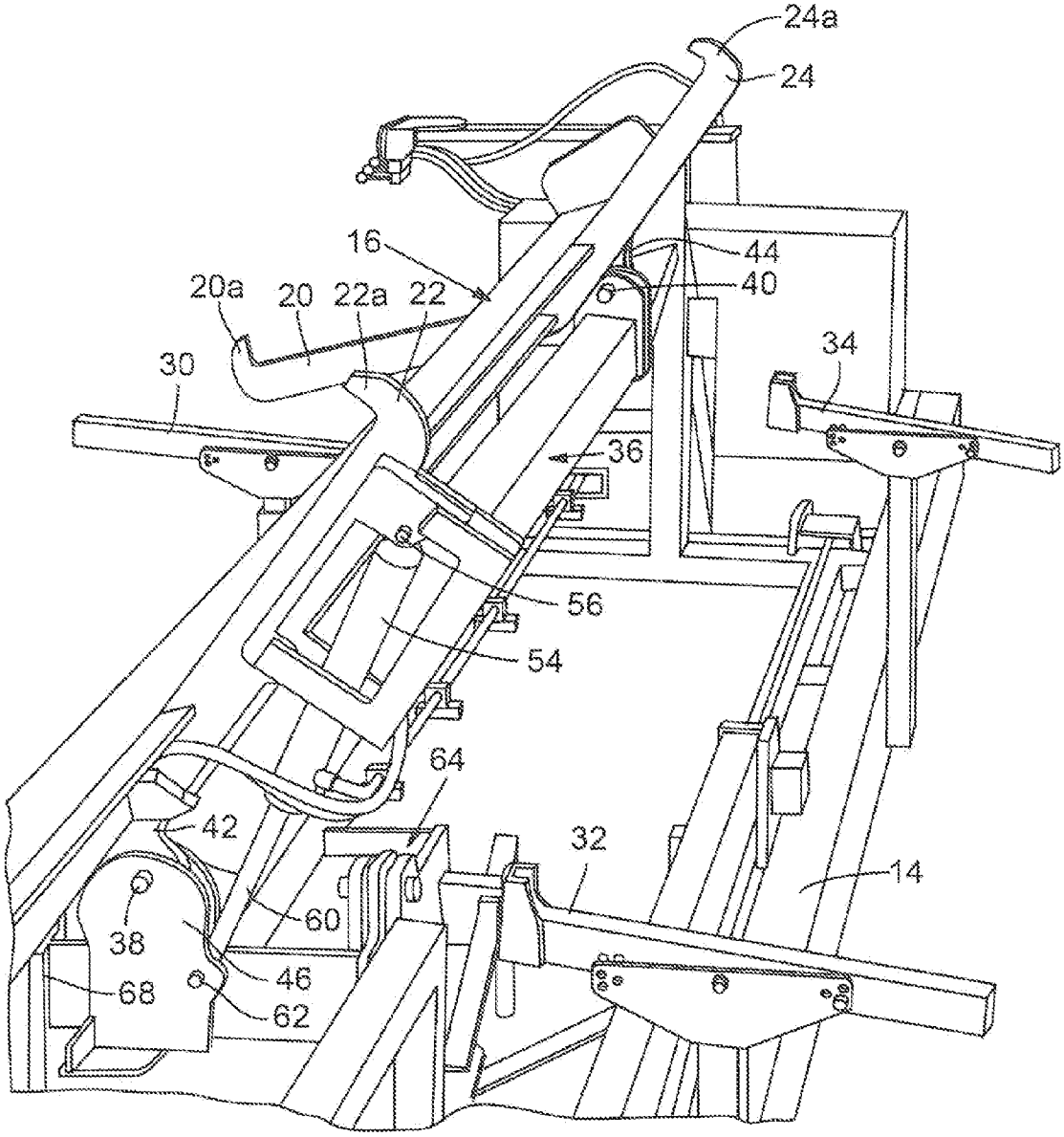
FIG. 2 is a perspective view taken slightly to one side, showing the pipe carrier being tilted, relative to the boom of the apparatus, prior to picking up of pipe from a pipe rack.
Figure 2A:
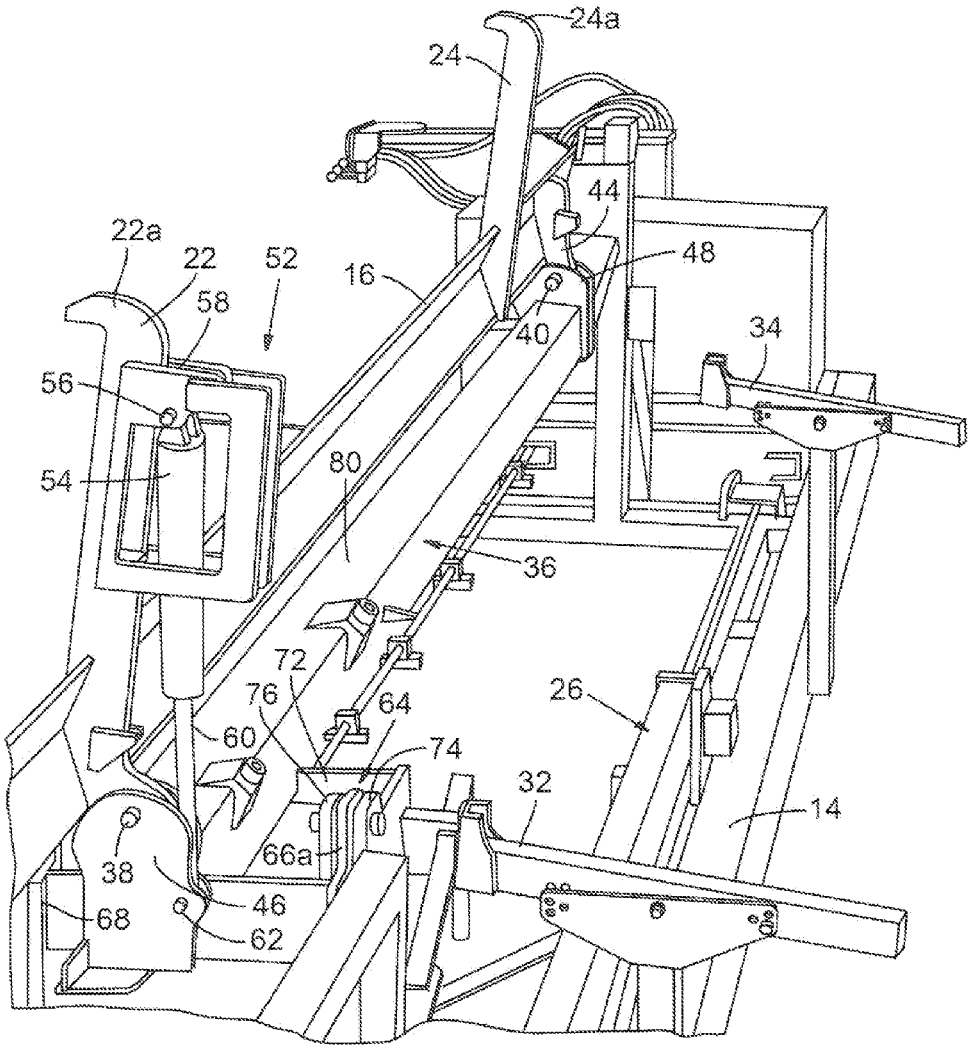
FIG. 2A is a view similar to FIG. 2 showing the pipe carrier fully tilted prior to picking up pipe from a pipe rack.

As shown in FIG. 2, pipe carrier 16 has been rotated about a longitudinal axis parallel to the boom, the latter of which is generally indicated at 36. The elongate axis is defined by spaced-apart pivots 38 and 40. As shown in FIG. 2A, pipe carrier 16 includes lugs 42 and 44 which extend downwardly, and are connected by pins at 38 and 40 to brackets 46 and 48, respectively. Bracket 46 is rigidly connected to the front end of boom 36, and bracket 48 is connected to and extends upwardly from a rear end of boom 36. Also shown in FIG. 2A is a first actuator or elevator actuator generally indicated at 52, for pivoting pipe carrier 16 about the elongate pivot axis defined by pivots 38 and 40. First actuator 52 includes a hydraulic cylinder 54 having one end thereof pivotally connected at 56 to brackets 58 which extend from elevator arm 22. A rod 60 extending from cylinder 54 is pivotally connected at 62 to bracket 46. It will be recalled that bracket 46 is rigidly connected to an end of boom 36. Thus, upon extension or retraction of rod 60 by actuation of first actuator 52, pipe carrier 16 and its associated elevator arms are rotated about the elongate axis extending between pivots 38 and 40.

Figure 7:
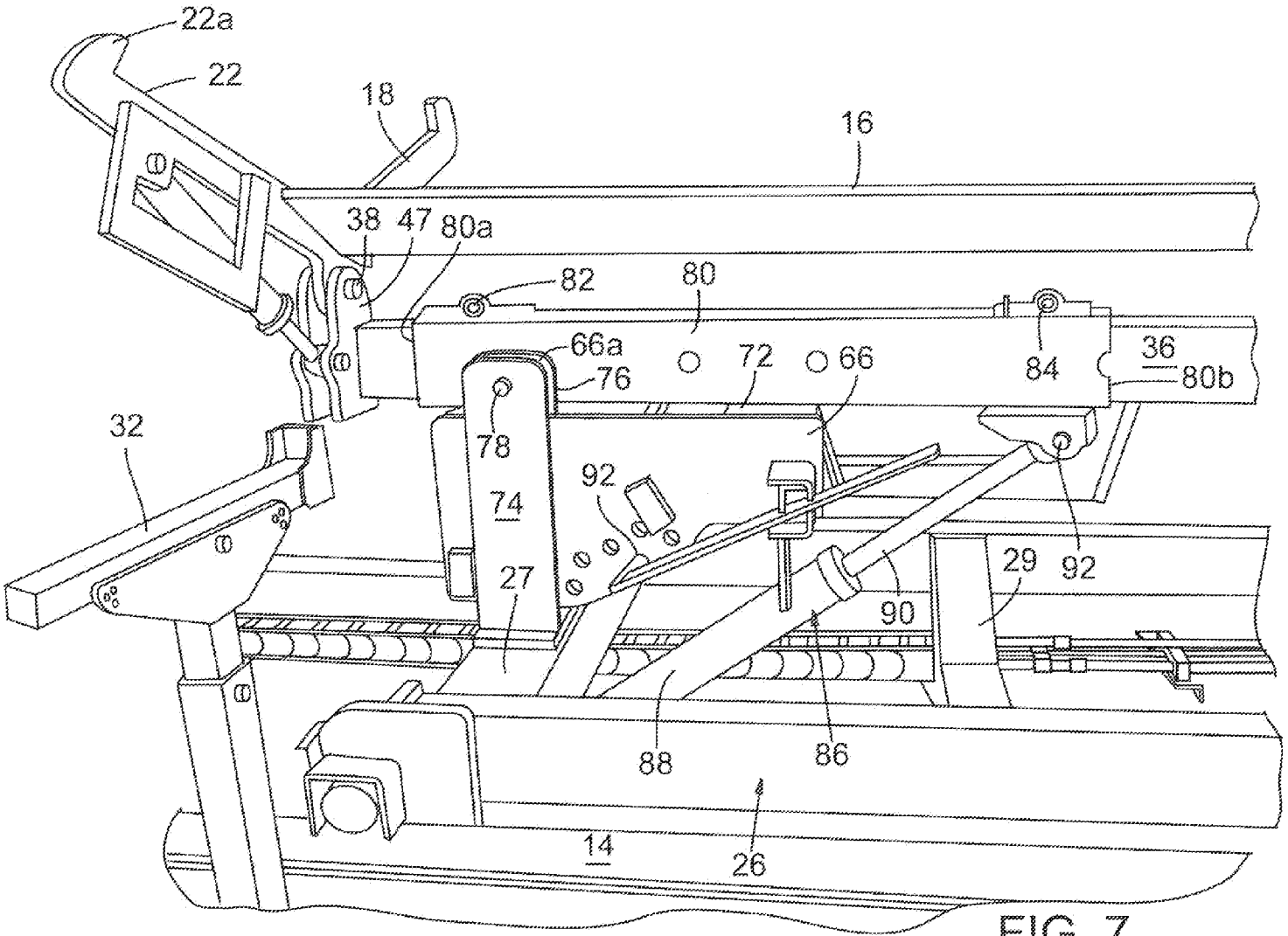
FIG. 7 is a close-up side view of the pivot assembly mounted on the carriage, with the boom retracted along its length and mounted to the pivot assembly so that it will pivot about a pivot axis near the front of the boom, for operation in a low configuration cycle.

Boom 36 is mounted onto carriage 26 and is selectively adjustable, longitudinally, relative to the carriage so that it can be pivoted at selected points along the boom's length. By providing different pivot points, the front end of the boom, and correspondingly the front end of pipe carrier 16, may be positioned at different heights. This selected positioning of the boom enables pipe to be delivered to drill rigs having different drill floor elevations. The construction of how boom 36 is mounted to carriage 26, and is pivotal relative thereto, can be appreciated from viewing FIG. 7, which shows a structure for mounting boom 36 to the carriage which also enables selective pivoting of the boom, and this will be referred to as a pivot assembly, generally indicated at 64. The pivot assembly includes a unit constructed with a pair of opposed plates 66 and 68 (see FIG. 2A), interconnected by cross members 70 and 72. Each of the plates includes an upwardly extending lug, such as lug 66*a* extending upwardly from plate 66, as shown in FIGS. 2A and 7. The lugs are suitably interconnected to uprights, such as shown at 74 and 76 by a pin connection indicated at 78, the same construction being on the opposite side of the view shown in FIG. 7. The pin connections, one of which is indicated at 78, are aligned to define a pivot axis, which is the axis that the boom will be pivoted about as will be explained.

As shown in FIG. 7, pivot assembly 64 includes a tubular sleeve 80 which is welded or otherwise rigidly connected to cross members 70 and 72. As shown in FIG. 7, the left end of sleeve 80 is indicated at 80*a* and the right end at 80*b*, and it is to be understood that boom 36 may be selectively shifted within sleeve 80 and securely affixed thereto by means of clamps 82 and 84.

Figure 8:
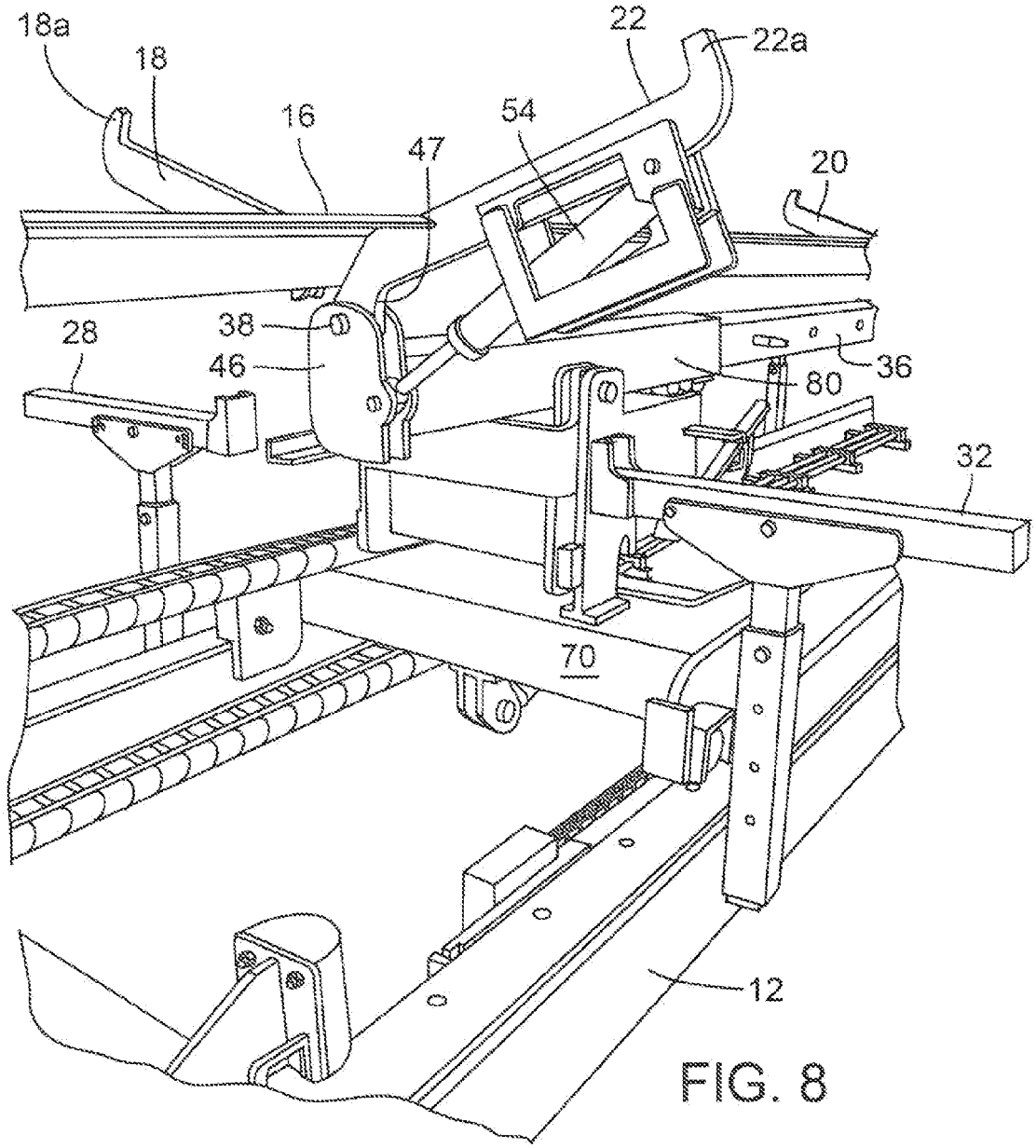
FIG. 8 is an enlarged view, taken in perspective near the front of the pipe handling apparatus showing the arrangement for operation in the low configuration cycle, with the pipe carrier in its neutral position.

A second actuator mechanism, generally indicated at 86, includes a hydraulic cylinder 88 having one end mounted beneath member 27 and is operable for extending and retracting a rod 90, which in turn is pivotally connected at 92 by a pin to sleeve 80. Thus it can be seen that upon retraction of rod 90, the tail end of boom 36 will be pivoted downwardly about pivot axis 78, and the front end of boom 36 will be raised along with a corresponding raising of the nose end of pipe carrier 16. Likewise, if cylinder 90 is extended, it will pivot boom 36 about pivot axis 78, in a clockwise direction in the configuration shown in FIG. 7. FIG. 8 is another view of the components which have been discussed, and shows that pipe carrier 16 extends forwardly of boom 36, and as mentioned previously, boom 36 is rigidly connected to brackets 46 and 47.

Figure 9:
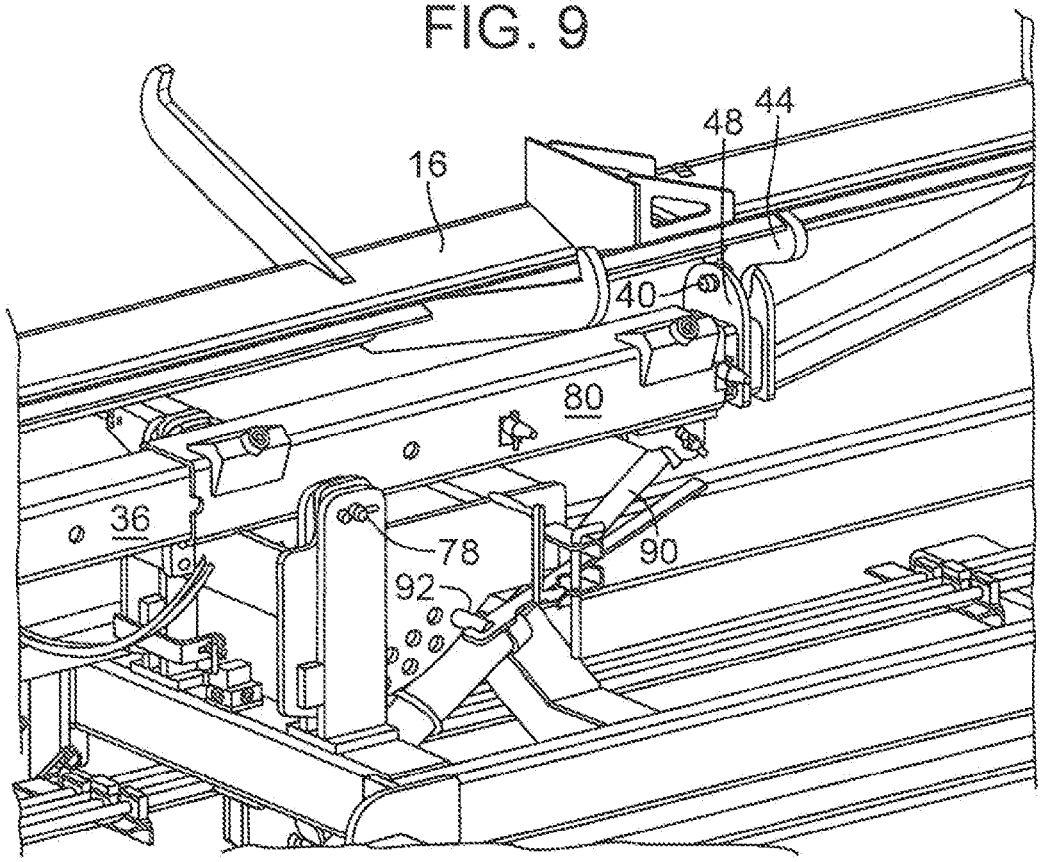
FIG. 9 is a view showing the pipe carrier in its neutral position with the boom shifted forwardly for mounting on the carriage so that the boom pivots about a pivot axis near the end of the boom for operation in the high configuration cycle.

FIG. 9 shows boom 36 extended forwardly through sleeve 80, in fact to its furthest forward position, so that the sleeve almost abuts bracket 48. In this configuration, which is contemplated for operation in the high configuration cycle, retraction of rod 90 will pivot the front end of boom 36 upwardly and correspondingly the nose of pipe carrier 16 to its greatest elevation, which here will be approximately 15 to 16 feet, as that is the design of this system. It will be noted that limit pin 92 has been placed in the rearward most one of the apertures in plate 66, therefore limiting the maximum height to which the second actuator can pivot boom 36 about pivot axis 78.

Interaction of Elevator Arms and Interface Arms

Figure 10:
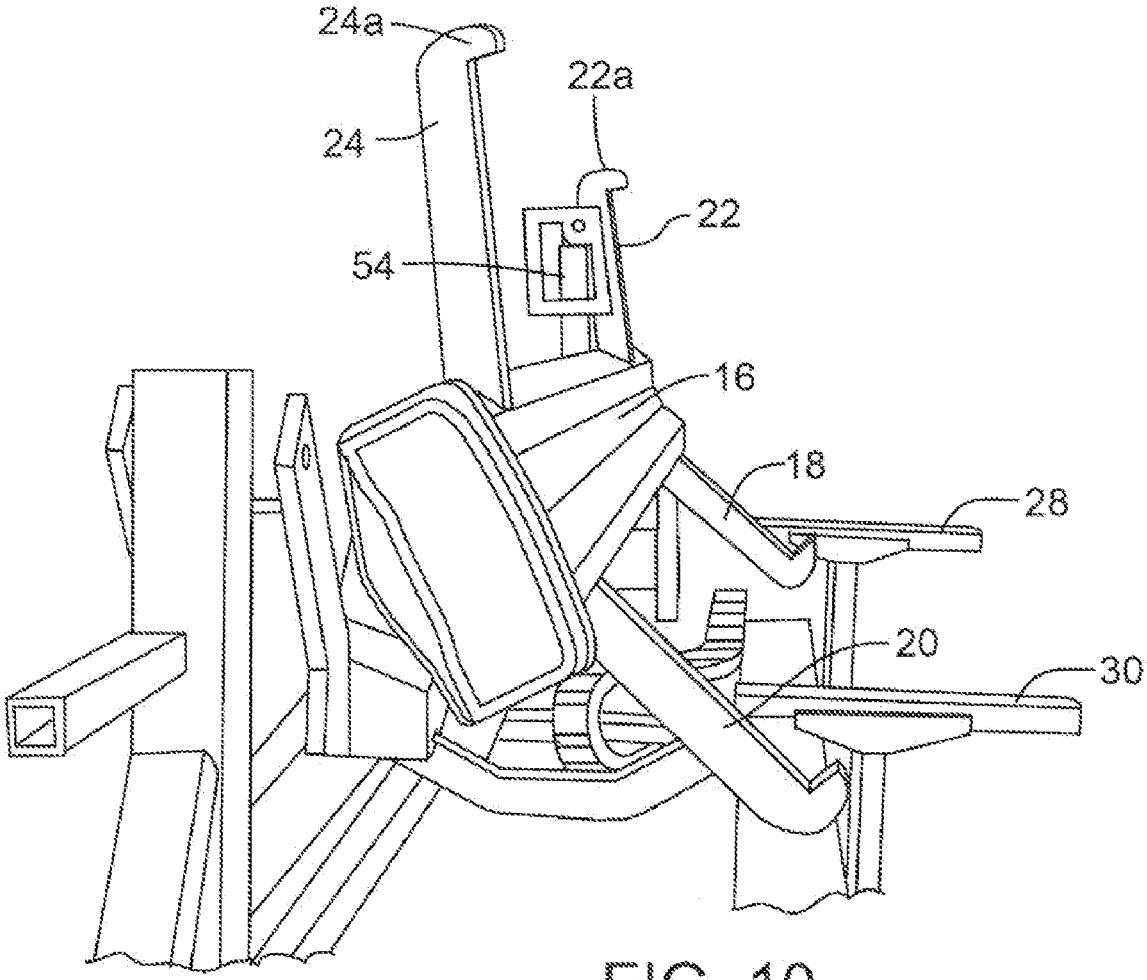
FIG. 10 is a view taken from the rear of the pipe handling apparatus illustrating operation of the elevator actuator to rotate the pipe carrier so that the elevator arms are positioned for receiving pipe to be loaded onto the pipe carrier from an adjacent pipe rack.
Figure 11:
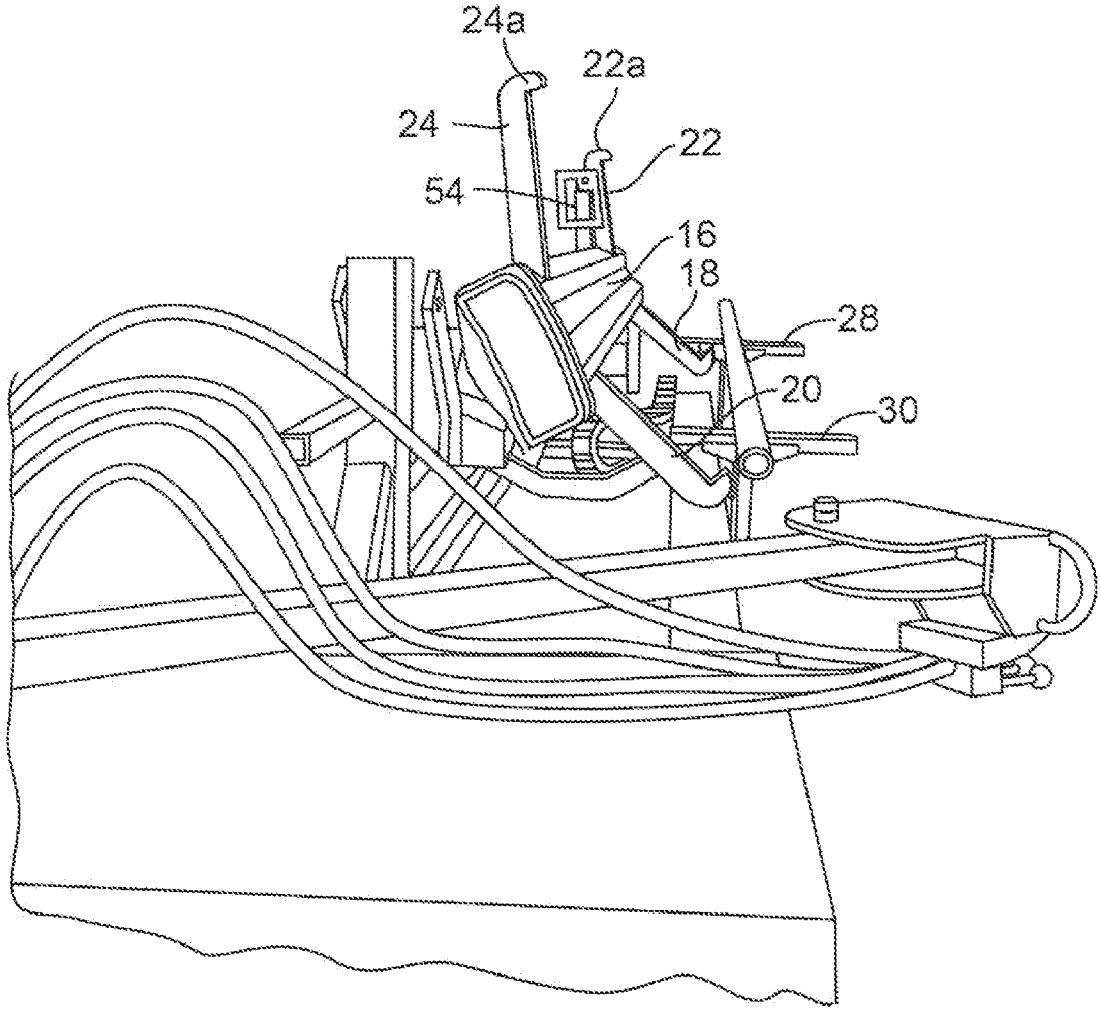
FIG. 11 shows a worker rolling pipe from the pipe rack onto interface arms adjacent the pipe carrier which has been rotated for receiving pipe.
Figure 12:
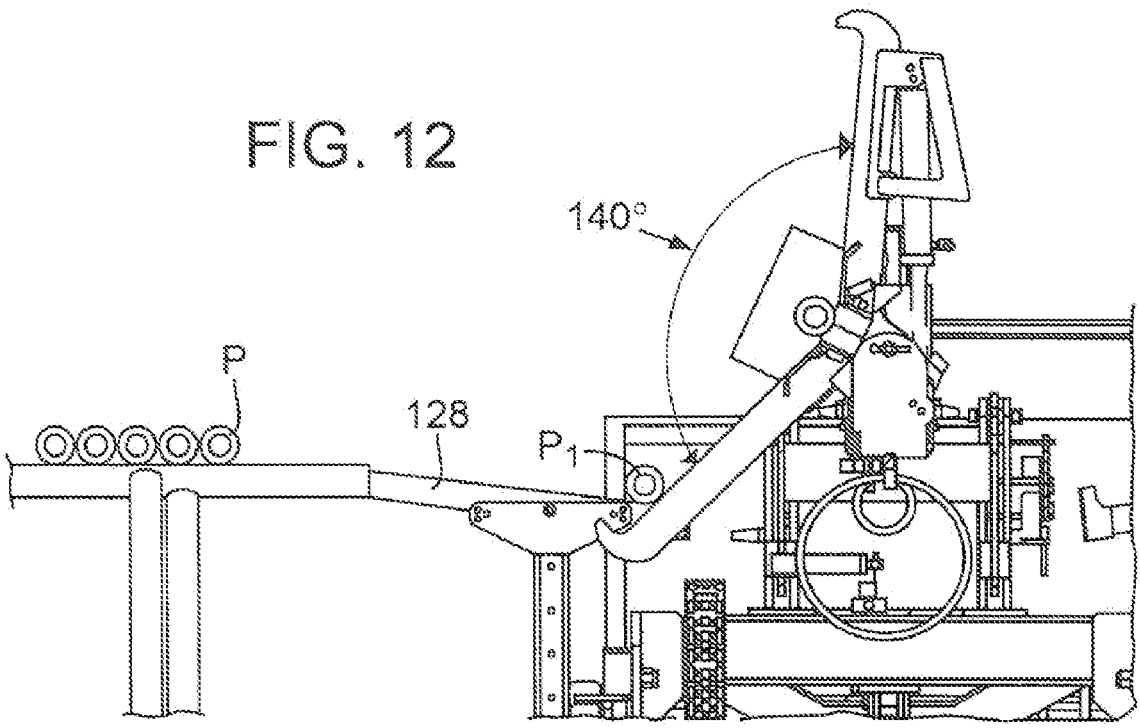
FIG. 12 is a view taken from the front of the pipe handling apparatus, showing the rotated pipe carrier with the elevator arms in position for receiving pipe from the pipe carrier.
Figure 13:
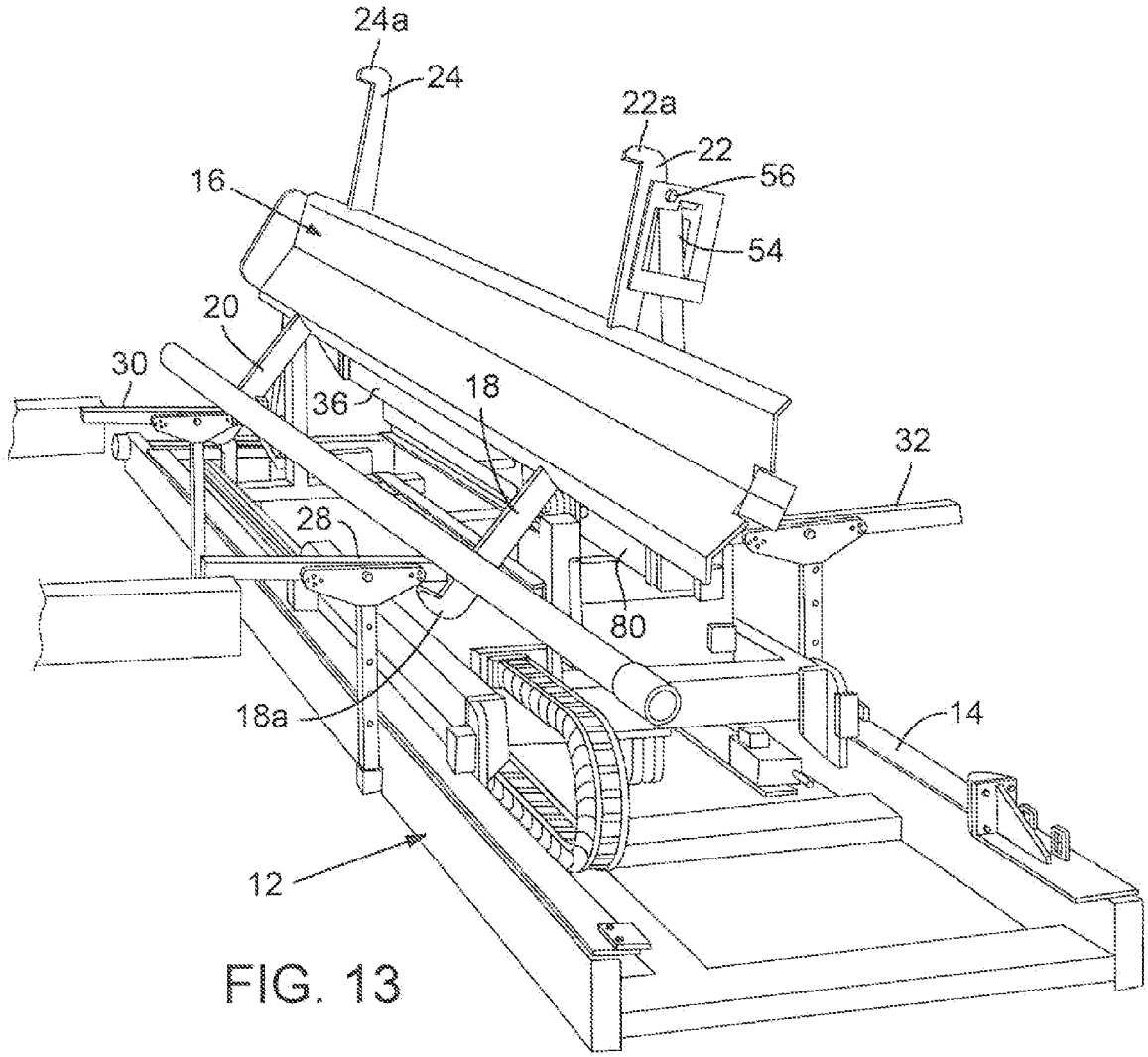
FIG. 13 is a view, taken in perspective from adjacent the front of the machine, showing pipe being engaged by an upper surface of the elevator arms prior to upward 20 rotation of the pipe carrier.

Attention is now directed to FIGS. 10-15, with initial consideration of FIG. 10 which shows how pipe carrier 16 may be pivoted in a first direction about the longitudinal axis defined by pivot axes 38 and 40 (see FIG. 2). Pipe, shown to the right, has previously been loaded onto a pipe rack, and it is desired to load that pipe onto pipe carrier 16. Orientation of the elevator arms, in combination with orientation of the interface rails, permits a single pipe at a time to be rolled by a worker along the pipe rack, onto the interface rails where the pipe is momentarily detained prior to be picked up by the elevator arms. As shown in FIG. 10, which is a view from the rear, the first actuator has been operated to move pipe carrier 16 in the clockwise direction, so that elevator aims 18 and 20, with their associated retainers, which may be hooks, 18*a* and 18*b*, respectively, are positioned beneath a portion of the upper surface or edge of interface rails 28, 30 respectively. Next, as shown in FIG. 11, a worker rolls a pipe from the pipe rack along the upper surface of the interface rails until the pipe engages the hook portion on each of the interface rails. This is essentially the position shown in FIG. 12, which is a view taken from the front of the apparatus. Pipe P1 has been rolled into position along the upper surface of the interface rails until it engages the hooks on the interface rails, and now first actuator 52 is operated to rotate pipe carrier 16 in the opposite or second direction so that the upper surface of the elevator arms engages the pipe and causes it to roll away from the hook portion of the pipe and eventually engage the hook portion of the elevator arms. FIG. 12 is shown just prior to the elevator arms being rotated so as to "pick-up" the pipe, and FIG. 13 shows this same position, where the hook on the elevator arms are about to engage the pipe.

Figure 14:
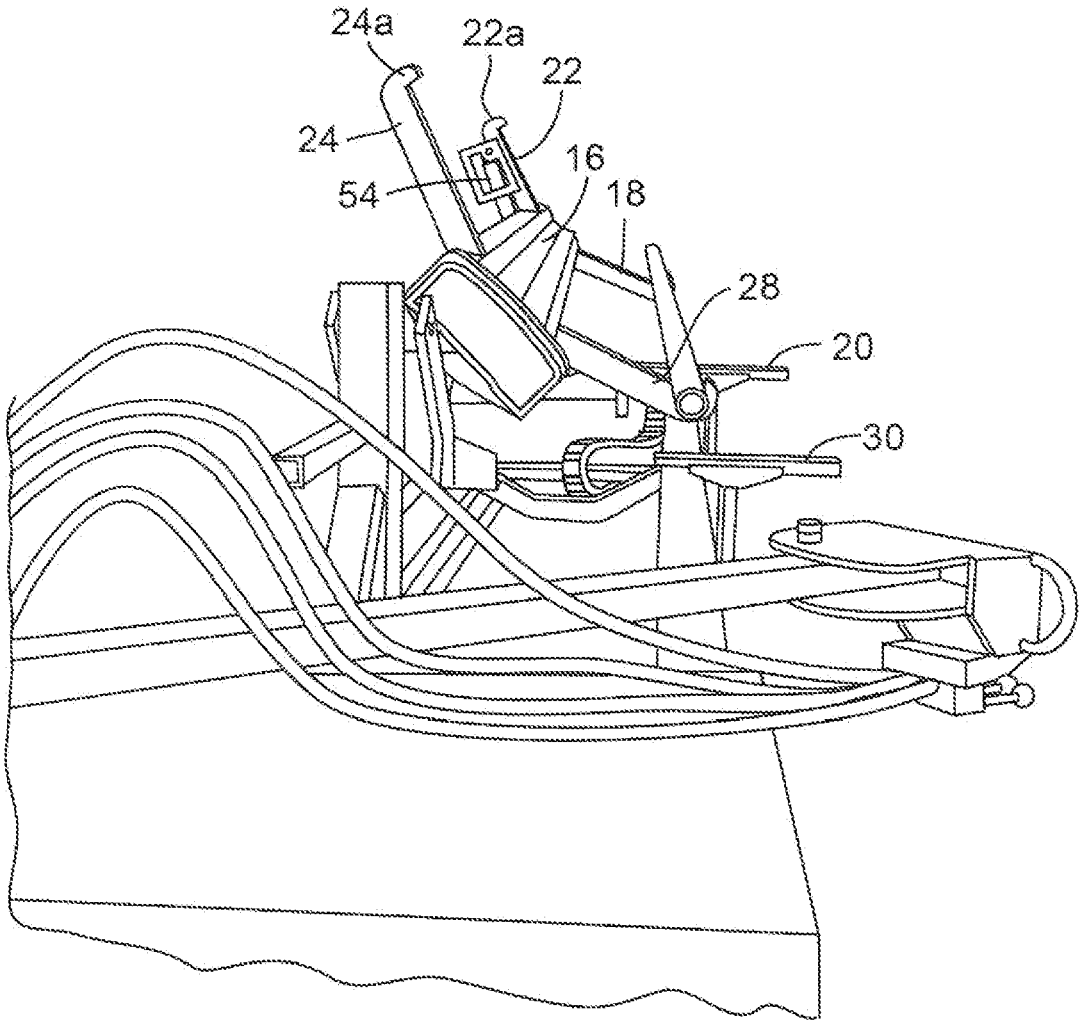
FIG. 14 is a view from the rear of the pipe apparatus showing further rotation of the pipe carrier with pipe supported on the elevator arms with the pipe now being lifted away from the interface arms.
Figure 15:
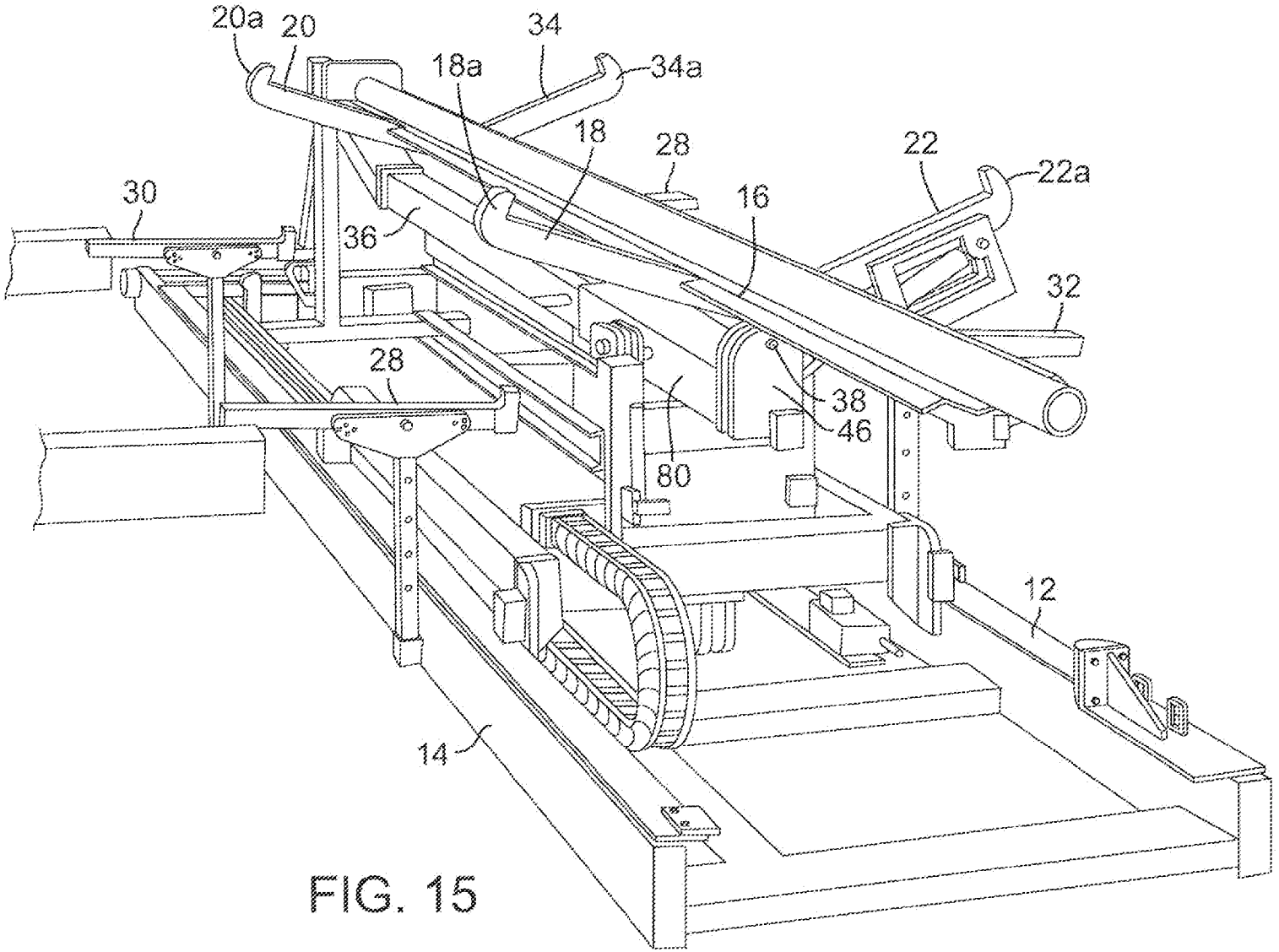
FIG. 15 is a perspective view showing the pipe having rolled down the upper 5 surfaces of the elevator arms for positioning in the central portion of the pipe carrier, now in its neutral position.

As shown in FIG. 14, elevator arms 18, 20 have picked up the pipe from interface rails 28 and 30 and further operation of the first actuator will rotate pipe carrier 16 eventually to its neutral position, and during that rotational movement, the pipe will roll down along the upper surfaces of elevator arms 18, 20 and into the elongate tray or trough portion of the pipe carrier. As shown in FIG. 15, pipe carrier 16 has been rotated by the first actuator into its neutral position, and with boom 36 mounted in the pivot assembly for the low configuration cycle, the apparatus is now in position for transferring the pipe to a drill rig, and in particular a drill rig having a drill floor at ground level or relatively low level, for example 5 feet.

Figure 16:
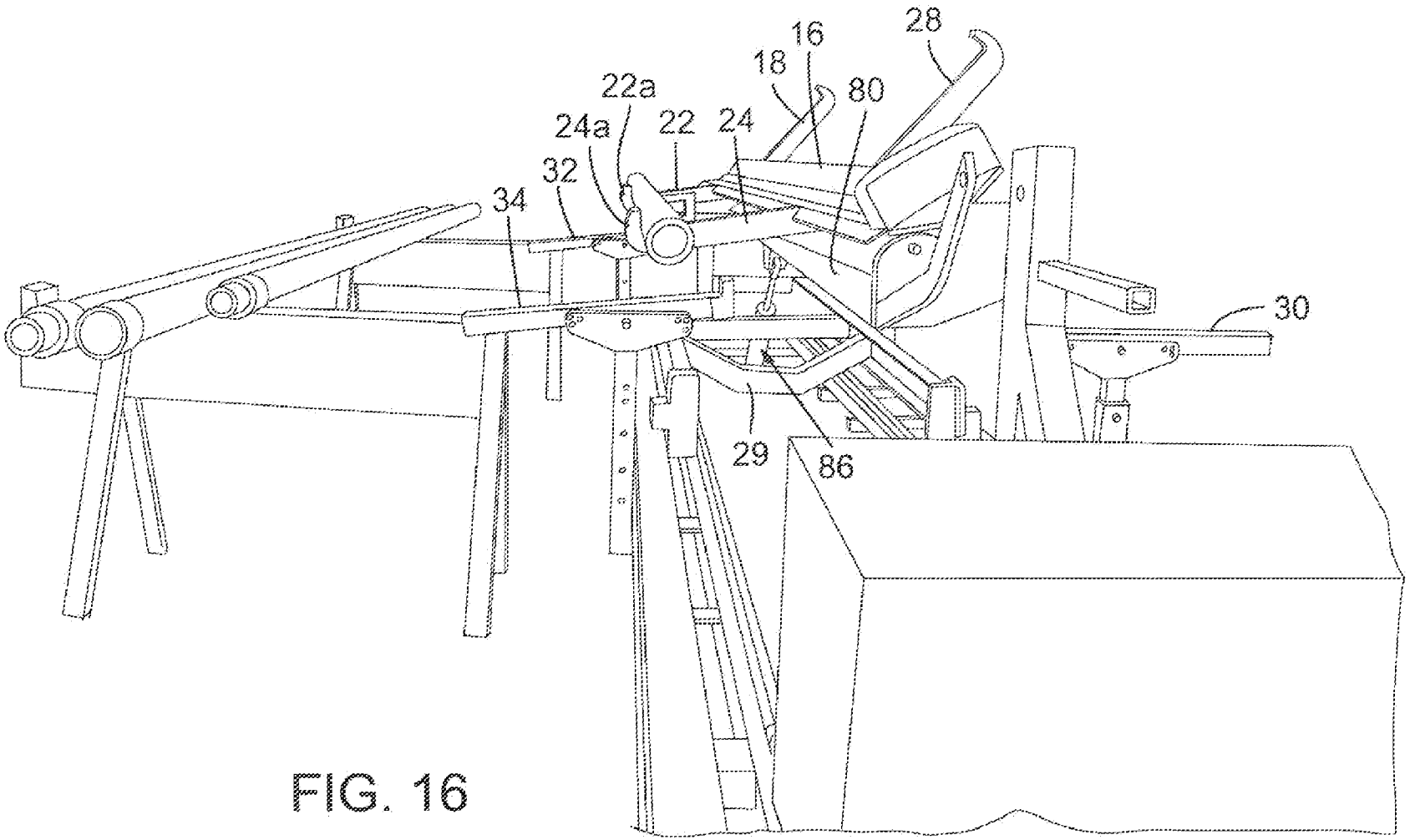
FIG. 16 shows pipe being transferred to the opposite side of the apparatus, when the pipe carrier is rotated in the opposite direction.

The height of the pipe carrier, when in its neutral position, is approximately 5 feet. That dimension has been selected because a worker who will be attaching a lifting device to the pipe can work on the ground comfortably by reaching with the hands to attach the lifting device to the end of the pipe. FIG. 16 shows offloading of pipe on the other side, for example, after pipe has been offloaded from a drill rig. Essentially the opposite procedure will take place, but the interface arms, as shown in FIG. 16, are angled to permit pipe to roll toward an adjacent pipe rack.

The method and apparatus of the present invention will be described with respect to FIGS. 3, 3A, 4 and 4A, which illustrate the method of operation of the pipe handling apparatus in picking up pipe from a pipe rack and delivering it to a drill rig which has a floor of low elevation, say in the range of 5 feet. A description will also be set forth of the so-called high configuration cycle and FIGS. 5, 5A, 6 and 6A illustrate operation in this mode. Each of the cycles will be first described with respect to delivering pipe from a pipe rack to a drill rig and then laying down pipe from a drill rig and returning it to a pipe rack.

Low Configuration Cycle

Delivering Pipe from Pipe Rack to Drill Rig

As shown in FIG. 1, apparatus 10 has been arranged with boom 36 positioned fully retracted within sleeve 80 of pivot assembly 64, and the sleeve is fixed to boom 36 at a forward end thereof. Pipe carrier 16 mounted on top of boom 36 is oriented to its neutral position, as shown in FIG. 3.

Figure 3:
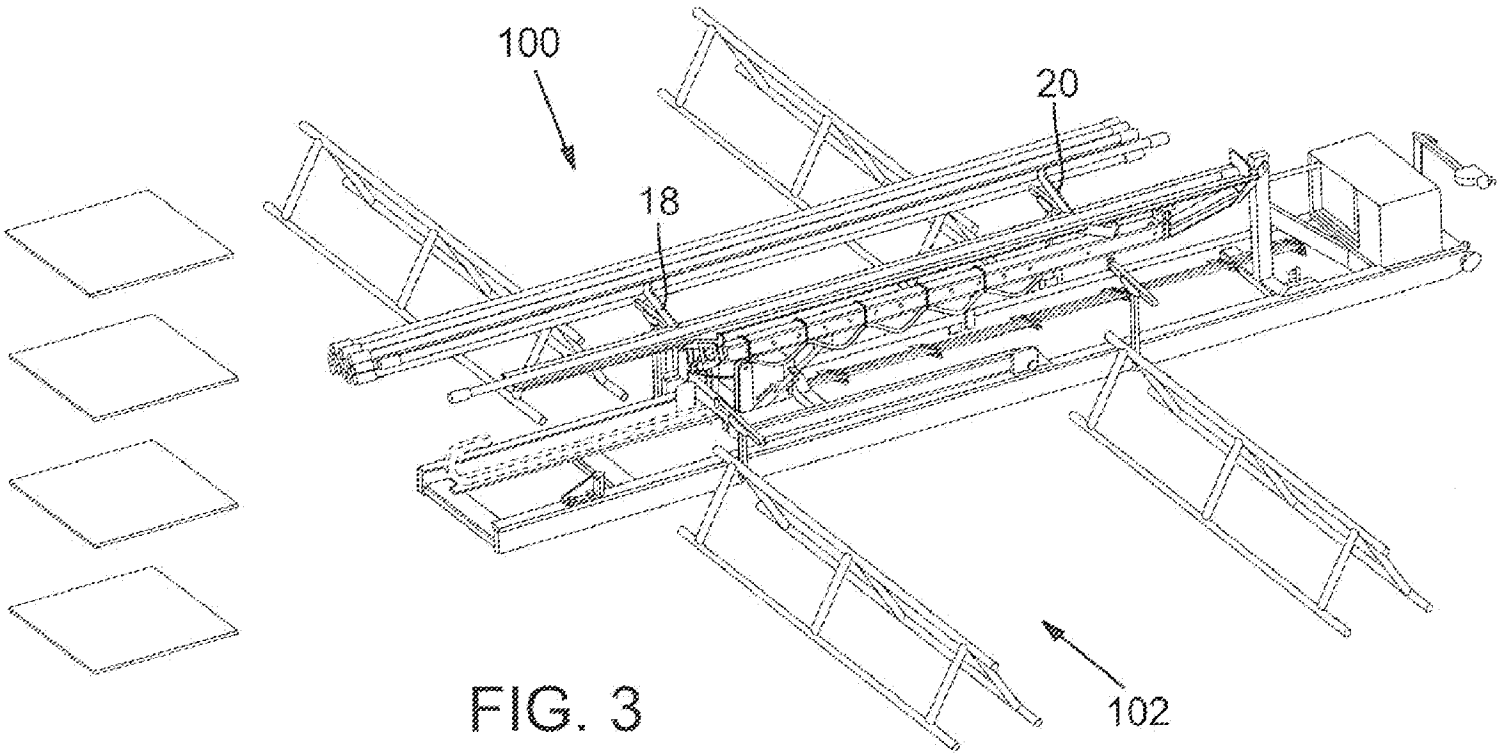
FIG. 3 is a view, taken in perspective, showing the principal components of the pipe handling apparatus arranged for delivery of pipe in the low configuration cycle; the boom is retracted within the sleeve of the pivot assembly and pipe has been received on the pipe carrier from a pipe rack, and the pipe carrier is in position to deliver the loaded pipe to a drill rig having a low configuration.
Figure 3A:
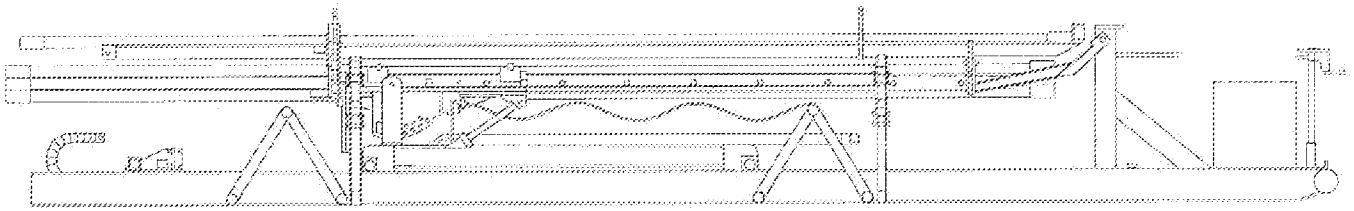
FIG. 3A is a side elevation view of the pipe handling apparatus shown in the configuration of FIG. 3.
Figure 4A:
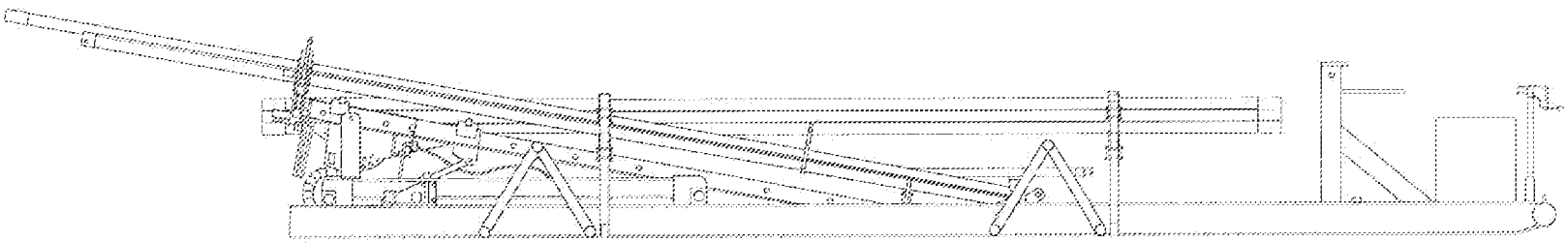
FIG. 4A is a side elevation view of the pipe handling apparatus and the configuration shown in FIG. 4.
Figure 4:
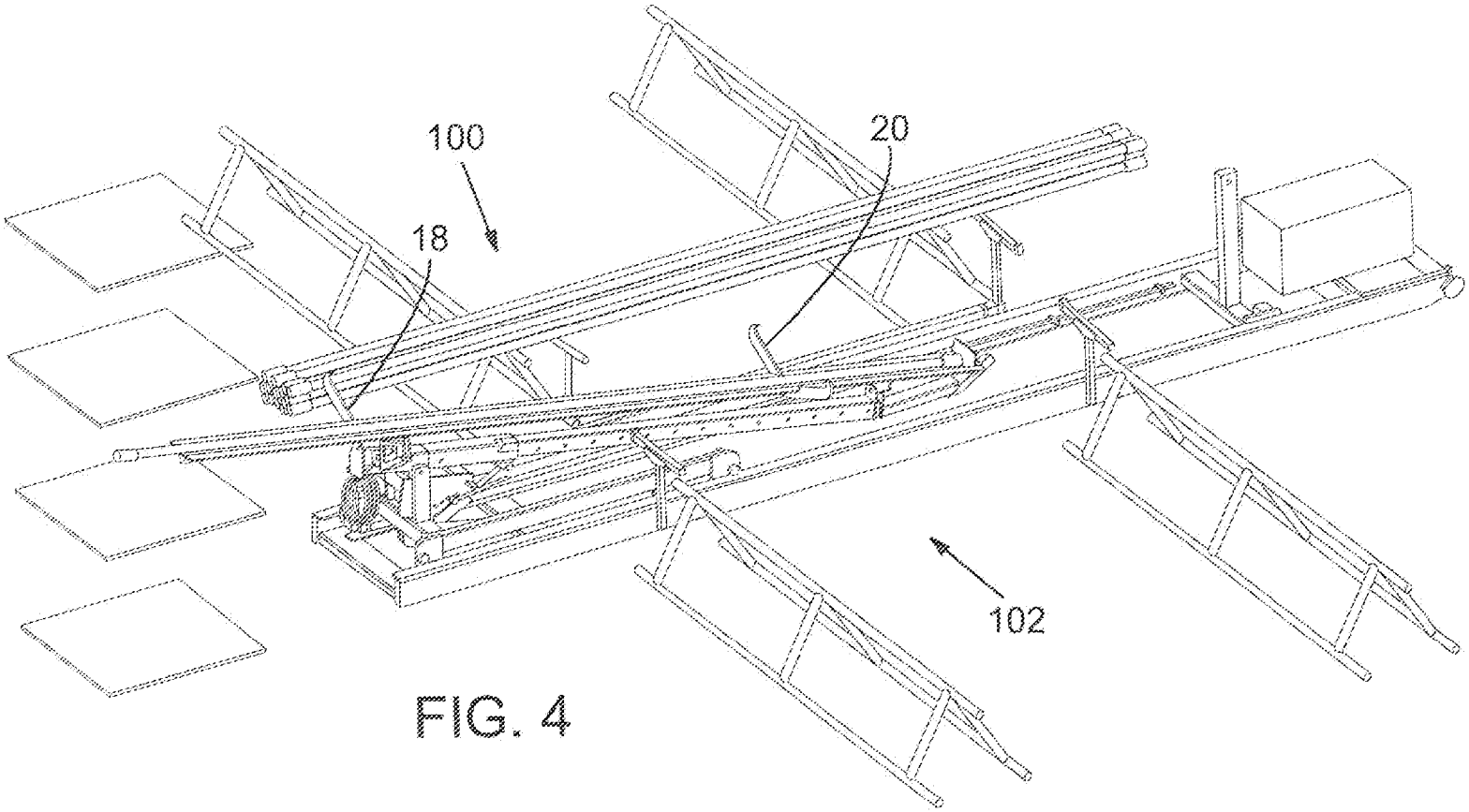
FIG. 4 is a view similar to FIG. 3 showing the carriage advanced to present the front end of both the pipe carrier and the pipe to the drill rig.
Figure 5:
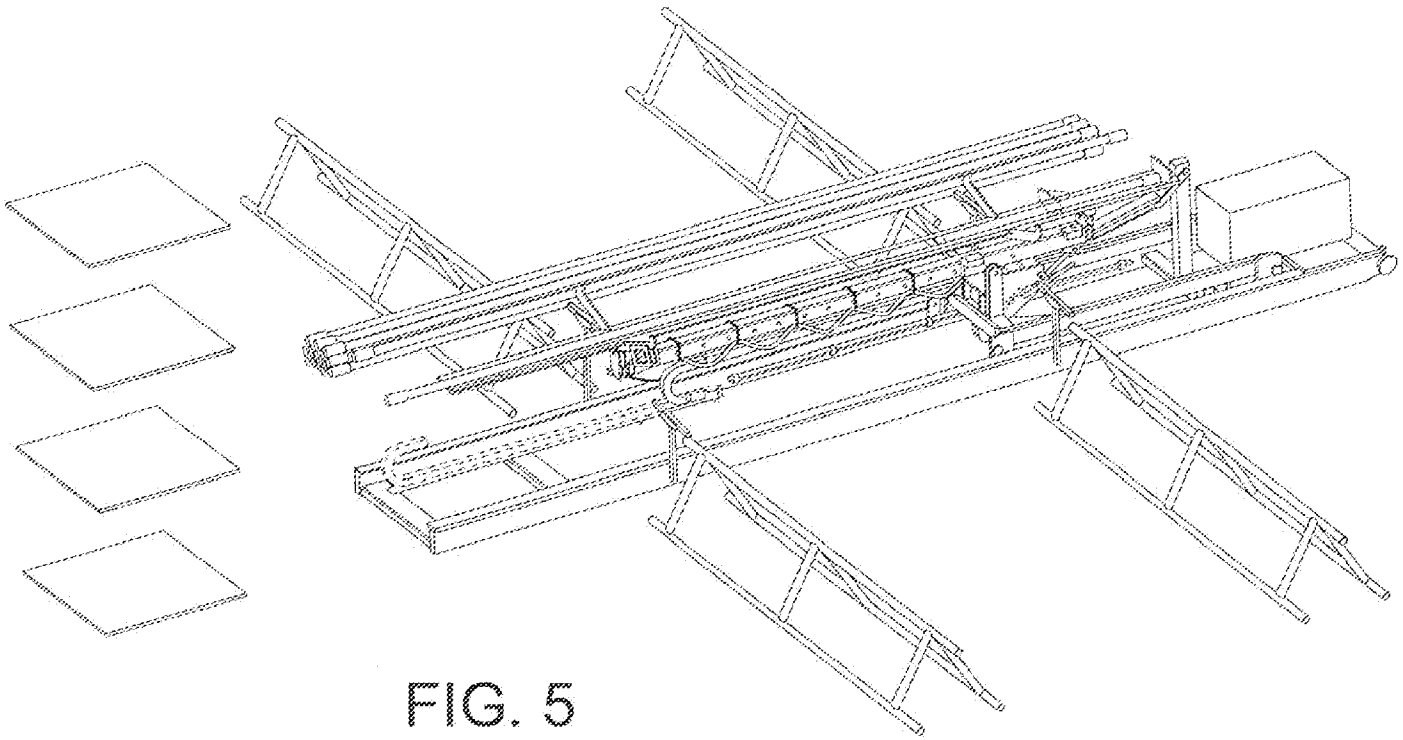
FIG. 5 is a perspective view of the pipe handling apparatus shown with the boom extended toward the front, relative to the carriage, with the pipe carrier oriented in its neutral position prior to delivering the loaded pipe to a drill rig having a high configuration.
Figure 6:
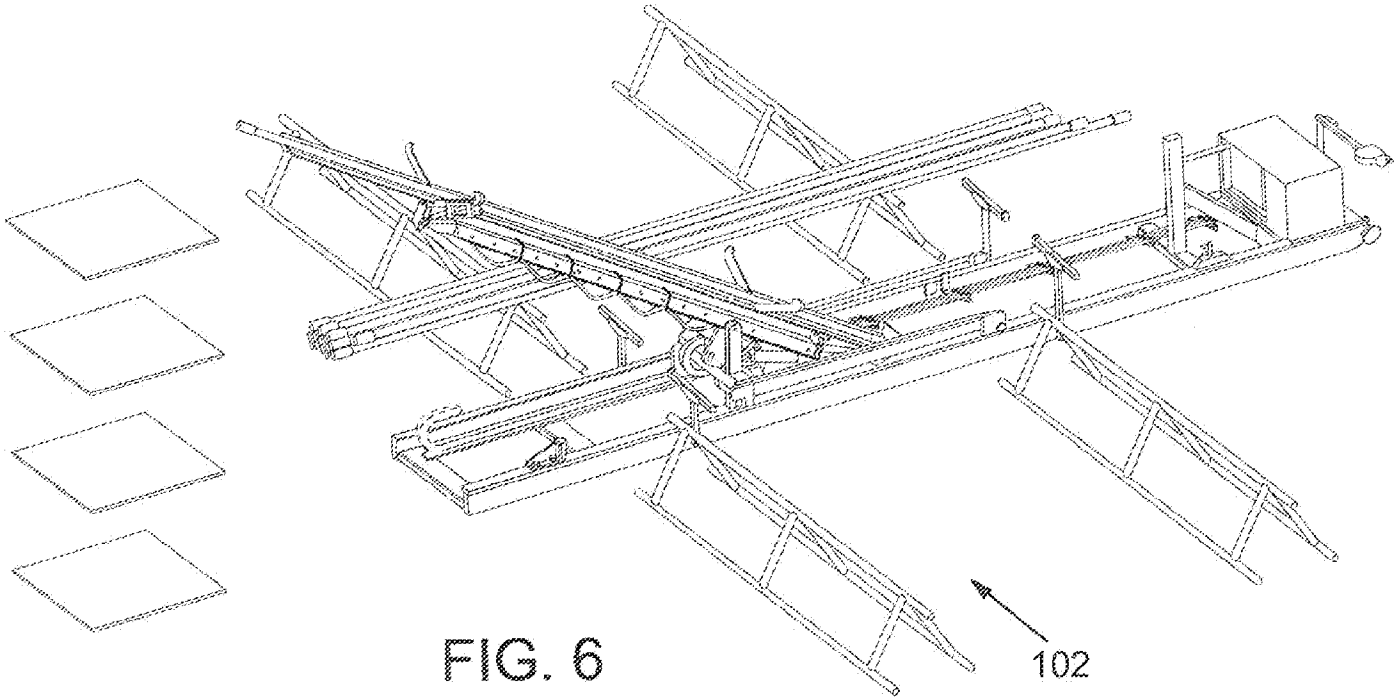
FIG. 6 is a view similar to FIG. 5 illustrating the carriage having been advanced while the rear end of the boom is pivoted downwardly about its connection to the carriage to elevate both the front end of the boom and pipe carrier to present the pipe to the drill rig, in this case a drill rig having an elevated drill floor in the high configuration.

Carriage 26 is retracted to a position, again as shown in FIG. 3, where pipe carrier 16 is generally parallel to a loaded pipe rack, and the first actuator is operated to rotate pipe carrier 16 in a first direction about a longitudinal axis relative to boom 36 so that a hook on each of the spaced-apart elevator arms, such as elevator arms 18 and 20 are positioned beneath interface arms 28, 30, respectively, now in a position to receive pipe from the pipe rack.

A pipe is then rolled from the pipe rack onto interface arms 28 and 30, and pipe carrier 16 is rotated in a second direction about its longitudinal axis by elevator cylinder 54 so that the pipe engages hooks 18*a* and 20*a* of elevator arms 18 and 20 and is picked off the interface arms 28 and 30.

The pipe carrier is further rotated in the second direction, so that the pipe disengages from the hooks to roll downwardly along upper surfaces of elevator arms 28 and 30 onto central portion 16*a* of the pipe carrier, which is finally returned to its neutral position.

Carriage 26 is advanced to present the front end of both the pipe carrier and the pipe to the drill rig. The lifting device from the drill rig is attached to a front end of the pipe, and is actuated to raise the pipe upwardly so that its rear end is dragged along pipe carrier 16 toward the drill rig until the pipe is raised to a substantially vertical position. The pipe is lifted away from the pipe carrier and into the drill rig. Carriage 26 is retracted to position it once again adjacent the pipe rack, and the process is repeated to deliver pipe to the drill rig as requirements dictate.

Laying Down Pipe from Drill Rig to Pipe Rack

Carriage 26 is advanced to a position adjacent the drill rig, and pipe to be removed from the drill rig is lifted by the lifting device and suspended to a position where a bottom end of the pipe is placed on the front portion of the pipe carrier, which is maintained in its neutral position. The rear end of boom 36 is pivoted downwardly about its connection to the carriage, so that a front end of boom 36 and pipe carrier 16 are raised, and the lifting device is actuated to lower the pipe continuously so that its rear end slides downwardly and rearwardly along inclined pipe carrier 16 until the rear end of the pipe engages stop 19 at the end of the pipe carrier.

The rear end of boom 36 is pivoted upwardly until both it and pipe carrier 16 are horizontal, and the lifting device lowers the pipe to lay it completely onto pipe carrier 16.

The lifting device is detached from the pipe, and carriage 16 is retracted to position the pipe and pipe carrier 16 adjacent a pipe rack for receiving the pipe. In the drawing of FIG. 3, another pipe rack for receiving pipe is shown at 102.

Elevator cylinder 54 is actuated to rotate pipe carrier 16 and elevator arms 22 and 24 so that the pipe rolls down the upper surface of elevator arms and across interface arms 22 and 24 and is laid onto pipe rack 102.

The elevator cylinder is then actuated to return pipe carrier 16 to its neutral position, and the carriage is extended so that the front end of both the boom tube and the 15 pipe carrier are presented to the drill rig, and the process is repeated to remove pipe from the drill rig as requirements dictate.

High Configuration Cycle

The method of operation is essentially the same as outlined above for the low configuration cycle, except that boom 36 must be adjusted incrementally within sleeve 80 so that the sleeve is fixed more rearward on boom 36, depending on the height of the drill rig floor. That is, sleeve 80 will be positioned more toward the rear on boom 36 as the drill rig floor raises in height from 5 feet to 10 feet, and from 10 feet to 15 feet, and so on. The pivot axis of the pivot assembly therefore will be at a point more toward the rear of the boom. The apparatus and method have been designed to reach successively higher drill rig floors. In the example given here, FIGS. 5, 5A, 6 and 6A illustrate how the pipe handling apparatus is operated in the high configuration cycle.

Delivering Pipe from Pipe Rack to Drill Rig

The boom is adjusted within sleeve 80 of the pivot assembly and is fixed to boom 36 at a position preselected so that the boom and pipe carrier can be elevated to enable the end of a pipe to be presented to the elevation of a drill rig floor. Pipe carrier 16 mounted on top of boom 36 is oriented in its neutral position. Carriage 26 is retracted to a position where pipe carrier 16 is generally parallel to a loaded pipe rack, such as pipe rack 100, and elevator cylinder 54 is actuated to rotate pipe carrier 16 in a first direction about a longitudinal axis relative to the boom so that hooks 18*a* and 20*a* on elevator arms 18 and 20, respectively, are positioned beneath interface arms 28 and 30 in a position to receive pipe from pipe rack 100.

A pipe is rolled from the pipe rack onto interface arms 28 and 30, and pipe carrier 16 is rotated in a second direction about a longitudinal axis by elevator cylinder 54 so that the pipe engages hooks 18*a* and 20*a* and is picked off the interface arms.

The pipe carrier is further rotated in the second direction, so that the pipe disengages from hooks 18*a* and 20*a* to roll downwardly along the upper surfaces of elevator arms 18 and 20 onto the central portion of pipe carrier 16, which is finally returned to its neutral position.

The carriage is then advanced, while the rear end of boom 36 is pivoted downwardly by cylinder 88 about its connection to carriage 26 to elevate both the front end of boom 36 and carrier 16 to present the pipe to the drill rig. Pivoting downwardly of the boom 36 can occur prior to, or simultaneously with, advancement of carriage 26.

The lifting device from the drill rig is attached to the front end of the pipe and actuated to raise pipe upwardly so that its trailing end is dragged upwardly along pipe carrier 16 toward the drill rig until the pipe is raised to a substantially vertical position adjacent the front end of pipe carrier 16, adjacent the drill rig floor. The pipe is then lifted away from pipe carrier 16 and into the drill rig.

Next, carriage 26 is retracted while the rear end of boom 36 is simultaneously pivoted upwardly until boom 36 and pipe carrier 16 are horizontally positioned, and carriage 26 is further moved to position it adjacent pipe rack 100, and the process is repeated to deliver pipe to the drill rig as requirements dictate.

Laying Down Pipe from Drill Rig to Pipe Rack

Carriage 26 is advanced, while the rear end of boom 36 simultaneously is pivoted downwardly about pivot axis 78 so that the front end of both boom 36 and pipe carrier 16 are raised and presented to the drill rig, and pipe to be removed from the drill rig is lifted by the lifting device and suspended so that a bottom end of the pipe is placed on the front portion of pipe carrier 16.

The lifting device is actuated to lower the pipe continuously enabling its rear end to slide downwardly and rearwardly along inclined pipe carrier 16 until the rear end of the pipe engages stop 19 at the end of pipe carrier 16. The lifting device continues to lower the pipe until it rests fully on pipe carrier 16, and the lifting device is detached from the pipe.

Carriage 26 is then retracted and the rear end of boom 36 simultaneously is pivoted upwardly until boom 36 and pipe carrier 16 are positioned horizontally, and carriage 26 is moved to a position adjacent a pipe rack, such as pipe rack 102 for receiving the pipe.

Elevator cylinder 54 is actuated to rotate pipe carrier 16 and elevator arms 22 and 24 so that the pipe rolls down the elevator arms and is laid onto the pipe rack.

Elevator cylinder 54 is then actuated to return pipe carrier 16 to its neutral position, and carriage 26 is advanced while the rear end of boom 36 simultaneously is pivoted downwardly about pivot axis 78 so that the front end of both boom 36 and pipe carrier 16 are raised and presented to the drill rig, and the process is repeated to remove pipe from the drill rig as requirements dictate.

We claim:

1. Apparatus for handling pipe comprising:

an elongate frame structure for mounting on a ground surface;

a carriage unit mounted on the frame structure selectively operable for reciprocal shifting along the frame structure;

a boom member mounted on the carriage unit operable for selective pivotal movement relative to the carriage unit, in a plane generally parallel to the boom member's longitudinal axis, about a generally horizontal pivot axis oriented transverse to the direction of shifting of the carriage unit along the frame structure, the boom member being selectively adjustable, longitudinally, relative to the carriage unit so that the boom member may be pivoted at selected points along the length of the boom member; and an elongate pipe carrier mounted on the boom member dimensioned for receiving pipe so that the pipe's longitudinal axis is substantially parallel to the longitudinal axes of the boom member and the pipe carrier, wherein the pipe carrier is operable for selective pivotal movement about its longitudinal axis.

2. The apparatus of claim 1 further including a first actuator mechanism mounted on the carriage unit selectively operable for pivoting the pivot assembly and the boom member about the pivot axis.

3. The apparatus of claim 2 further including a second actuator mechanism mounted on the boom member selectively operable for pivoting the pipe carrier about its longitudinal axis relative to the boom member.

4. The apparatus of claim 3 wherein spaced-apart arms are mounted on the pipe carrier extending at an angle outwardly from one side thereof for receiving pipe from a pipe rack or the like.

5. The apparatus of claim 4 wherein the spaced-apart arms are provided with retainers for engaging pipe as it initially is removed from a pipe rack.

6. Apparatus for transferring pipe from a first station and presenting it to an elevated second station, comprising:

an elongate frame structure for mounting on a ground surface;

a carriage unit mounted on the frame structure selectively operable for reciprocal shifting along the frame structure;

a boom member mounted on the carriage unit operable for selective pivotal movement relative to the carriage unit, in a plane generally parallel to the boom member's longitudinal axis, about a pivot axis generally oriented horizontally and transverse to the direction of shifting of the carriage unit along the frame structure, the boom member being selectively adjustable, longitudinally, relative to the carriage unit so that the boom member may be pivoted at selected points along the length of the boom member;

an elongate pipe carrier mounted on the boom member dimensioned for receiving pipe so that the pipe's longitudinal axis is substantially parallel to the longitudinal axes of the boom member and the pipe carrier;

arm members rigidly mounted on and extending laterally from opposite sides of the pipe carrier;

a first actuator mechanism mounted on the carriage unit selectively operable for pivoting the boom member and the pipe carrier about the pivot axis from a substantially horizontal position to a selected inclined position;

a second actuator mechanism mounted on the boom member selectively operable for pivoting the pipe carrier about its longitudinal axis relative to the boom member in a first direction so that pipe from a first station may engage the arm members on one side of the pipe carrier, the second actuator mechanism operable for pivoting the pipe carrier in a second direction to permit pipe to roll onto the pipe carrier; and power-driven means mounted on the frame structure selectively operable for advancing the carriage unit from the first station to a position adjacent the second station, wherein the first actuator mechanism can be operated to pivot the boom member to incline it upwardly, thereby presenting a forward end of the pipe to the second station, and for retracting the carriage unit from a position adjacent the second station to a position adjacent the first station.

7. A method of handling pipe, comprising:

providing a carriage unit mounted on a frame structure selectively operable for reciprocal shifting along the frame structure;

selectively positioning a boom member on the carriage unit so that the boom member may be pivoted about a selected horizontal axis;

orienting the boom member and a pipe carrier mounted thereon to a position for receiving a pipe;

rolling a pipe onto the pipe carrier;

pivoting the front ends of the boom member and the pipe carrier to a desired height;

shifting the carriage unit along the frame structure; and presenting the pipe to a drill rig floor so that the pipe may be lifted from the pipe carrier onto the drill rig.

8. The method of claim 7, comprising simultaneously pivoting the front ends of the boom member and the pipe carrier to a desired height and shifting the carriage unit along the frame member.

9. The method of claim 7, wherein orienting the boom member and the pipe carrier to a position for receiving a pipe comprises rotating the boom member and pipe carrier from a neutral position in a first direction about a longitudinal axis relative to the boom member.

10. The method of claim 9, wherein rolling a pipe onto the pipe carrier comprises rotating the boom member and pipe carrier in the opposite direction about the longitudinal axis relative to the boom member.

* * * * *